US006428010B1

(12) United States Patent
Förster et al.

(10) Patent No.: US 6,428,010 B1
(45) Date of Patent: Aug. 6, 2002

(54) SEALING STRIP

(75) Inventors: Andreas Förster, Schweinfurt; Stefan Schiffler, Wonfurt, both of (DE)

(73) Assignee: Mannesmann Sachs AG, Schweinfurt (DE)

( * ) Notice: Subject to any disclaimer, the term of this patent is extended or adjusted under 35 U.S.C. 154(b) by 0 days.

(21) Appl. No.: 09/627,463

(22) Filed: Jul. 28, 2000

(30) Foreign Application Priority Data

Jul. 28, 1999 (DE) ..... 199 35 234

(51) Int. Cl.[7] ..... F01C 19/10

(52) U.S. Cl. ..... 277/357; 277/470; 277/489; 418/114; 418/121; 92/125

(58) Field of Search ..... 277/357, 467, 277/470, 489, 472, 473, 503; 188/296; 418/113, 114, 121; 92/125

(56) References Cited

U.S. PATENT DOCUMENTS

| | | | | | |
|---|---|---|---|---|---|
| 3,021,822 | A | * | 2/1962 | Rumsey | |
| 3,127,095 | A | * | 3/1964 | Froede | |
| 3,131,610 | A | * | 5/1964 | Paulus | |
| 3,186,384 | A | * | 6/1965 | Fuhrmann | |
| 3,207,047 | A | * | 9/1965 | O'Connor | |
| 3,235,171 | A | * | 2/1966 | Frenzel et al. | |
| 3,263,912 | A | * | 8/1966 | Frenzel | |
| 3,268,157 | A | * | 8/1966 | Frenzel | |
| 3,485,217 | A | * | 12/1969 | Irgens | |
| 3,820,798 | A | * | 6/1974 | Lamm | |
| 3,932,074 | A | * | 1/1976 | Morris | 418/113 |
| 3,963,388 | A | * | 6/1976 | Goloff | 418/121 |
| 4,144,003 | A | * | 3/1979 | Berkowitz | 418/113 |
| 4,156,586 | A | * | 5/1979 | Morris | 418/113 |
| 4,931,001 | A | * | 6/1990 | Lauter | 418/113 |
| 5,305,721 | A | * | 4/1994 | Burtis | 123/205 |
| 5,492,051 | A | * | 2/1996 | Schiffler et al. | 92/125 |
| 5,538,409 | A | * | 7/1996 | Cureton et al. | 418/142 |
| 5,813,316 | A | * | 9/1998 | Sekiya et al. | 92/121 |
| 5,839,346 | A | * | 11/1998 | Sekiya et al. | 92/5 R |
| 6,181,034 | B1 | * | 1/2001 | Reichel et al. | 310/36 |

FOREIGN PATENT DOCUMENTS

| | | |
|---|---|---|
| DE | 19 55 711 | 2/1967 |
| DE | 43 37 815 C1 | 2/1995 |
| DE | 43 43 924 A1 | 6/1995 |

* cited by examiner

*Primary Examiner*—Anthony Knight
*Assistant Examiner*—Alison K. Pickard
(74) *Attorney, Agent, or Firm*—Cohen, Pontani, Lieberman & Pavane

(57) ABSTRACT

A sealing strip is provided for sealing a space between two parts of a machine, for example, a rotary engine. The two parts form a groove for receiving the sealing strip. The sealing strip includes a filler piece, at least one spring element, at least one sealing body and a separating element. The filler piece is divided into two filler piece parts along the longitudinal direction. The filler piece parts are capable of independent longitudinal displacement with respect to one another. A spring element is arranged between the filler piece parts for preloading the filler piece into the groove. Each sealing body is formed in a frame-like shape for surrounding an end of the filler piece. The separating element is arranged between the filler piece parts for separating the filler piece parts and extends longitudinally from an end of the divided filler piece to at least a point where a sealing body surrounds the divided filler piece. The present invention minimizes leakage rate and does not require excessive spring forces.

17 Claims, 9 Drawing Sheets

A-A

B-B

C-C

SEALING STRIP

BACKGROUND OF THE INVENTION

1. Field of the Invention

The invention relates to a sealing strip for sealing two machine parts. More specifically, the invention is a sealing strip having a separation element that effectively prevents two longitudinal sealing strips from coming into frictional contact and provides excellent sealing properties.

2. Description of the Related Art

German reference DE-U 19 55 711 discloses a radial piston seal for a rotary machine in which a filler body, under preloading, bears a sealing body. The filler body is divided in the transverse direction and is preloaded in the longitudinal direction by a spring element. The sealing bodies on both sides of the filler body must be fixedly connected to the filler body. Consequently, the internal stress of the sealing bodies counteracts the spring force of the spring element. The sealing bodies are of disk-like design and therefore cover a movement gap between the filler body parts.

One problem with this configuration is that the sealing bodies inevitably have a relatively large cross section and therefore a corresponding spring rate in the longitudinal or tension direction. Consequently, it is necessary to employ relatively high spring forces, but because of the space available these can only be achieved with difficulty. Once could envisage the sealing bodies being of annular design, in accordance with the principle described in DE 43 37 815 A1, but then there would be a leakage problem, since the movement gap between the filler pieces is not covered.

German reference DE 43 43 924 A1 describes a sealing arrangement for sealing two machine parts which move in translation relative to one another. The sealing arrangement comprises two sealing parts which, via a connecting web, form a single-piece unit, the connecting web being closed over its entire surface.

SUMMARY OF THE INVENTION

The object of the present invention is to develop a sealing strip which is preloaded in the longitudinal direction, in which the spring forces required are low and the leakage rate is minimized.

The separating element effectively prevents the two longitudinally displaceable sealing strips from coming into frictional contact or even a positive lock caused by deformation forces.

Briefly stated, the present invention is a sealing strip for sealing a space between two parts of a machine. The two parts form a groove for receiving the sealing strip. The groove has at least one wall along a longitudinal direction and a base. The sealing strip includes a filler piece, at least one spring element, at least one sealing body and a separating element. The filler piece has a top end and a bottom end and is divided into two filler piece parts along the longitudinal direction. The filler piece parts are capable of independent longitudinal displacement with respect to one another. The at least one spring element is arranged between the filler piece parts for preloading the filler piece into the groove. There is one sealing body for the top end and one sealing body for the bottom end of the filler piece. Each sealing body is formed in a frame-like shape for surrounding its respective end of the filler piece. The separating element is arranged between the filler piece parts for separating the filler piece parts and extends longitudinally from an end of the divided filler piece to at least a point where a sealing body surrounds the divided filler piece.

In a further embodiment of the present invention, the filler piece has at least one pocket-like cutout in which the at least one spring element is arranged. This prevents the possibility of a leak forming. Furthermore, contact between the groove side walls and the spring element, which could impair the function of the spring element, is prevented.

Advantageously, the preloading is exerted on the sealing body by a separate preloading element, the preloading element being guided at the sides by at least one web of the filler piece. As a result of the functions of "generating the preloading force" and "sealing" being separate, it is possible in each case to use optimized materials. The web section facilitates the fitting of the sealing strip as a whole, since the position of the preloading element inside the sealing strip is defined. In a further advantageous configuration, the web is designed as at least one web section, and furthermore the web section of the filler piece is formed on a single end-side end face. By means of the web on the end face, the compressive stress caused by the load exerted by the spring element on the sealing body is reduced, since the end face bears part of this force. Furthermore, the web section is restricted to one end-side end face. A greater degree of design freedom is obtained by dispensing with a web on all sides.

Furthermore, the sealing body has a transition surface between a sealing surface on the groove base side and a sealing surface on the groove wall side. In terms of production engineering, it is difficult to produce a sharp-edged transition in the region of contact between two groove surfaces. Therefore, the sealing body is also designed with a transition surface.

To prevent the sealing strip from being fitted the wrong way round, the transition surface is formed on both sides starting from the sealing surface on the groove base side.

The transition between the groove base and the groove side walls can only be produced within a limited manufacturing tolerance if acceptable outlay is to be maintained. To ensure that it is still not necessary to accept leakage in the region of the transition surface, a defined deformation area along a limited region of the length of the sealing surface is provided on the groove base side and on the groove wall side. Limiting the deformation area has the advantage that only a small volume has to be adapted to the shape of the groove and therefore the formation forces are kept at a low level.

In view of the different requirements imposed on the action of the force from the preloading element, the preloading element is of different cross-sectional sizes over its peripheral length.

For example, the preloading element is of an average cross-sectional size in the region which comes into contact with the top and bottom sides of the filler piece compared to the other regions of the preloading element.

Therefore, the preloading body has a larger cross section in the region of that end face of the filler piece which is not subjected to pressure from the spring force of the spring element, while in the region of that end face which is subjected to pressure it is of a smaller cross-sectional size, compared to the average cross-sectional size. This makes it possible, on the one hand, to provide sufficient volume to be able to compensate for temperature-related changes in length and, on the other hand, to produce a sealing body of optimum size. It is desirable for the filler piece to have a coefficient of expansion similar to that of the sealing body.

In a further embodiment, the separating element is of elastic design in its plane which is perpendicular to the direction of force from the at least one spring element. For this purpose, the separating element has at least one transverse opening.

In view of the design of the sealing body, the separating element, over a length region, is of a greater height than the groove which is to be sealed. The aim is to avoid a leak occurring in the groove formed by the adjacent transition surfaces of the sealing bodies.

To minimize the compressive stresses in the separating element, the length region which is of the greater height is arranged in the region of the cutout.

A further measure for preventing a leak between the sealing bodies consists in the length region, of the separating element, which is of the greater height and the defined deformation area of the sealing body having an overlap in the longitudinal direction of the sealing strip. The intention is to prevent the deformation areas provided on the sealing bodies and on the separating element from forming a labyrinth while nevertheless allowing medium to flow around them.

To ensure that there is no need to take into account positional orientation about the transverse axis when fitting the separating element, the length region which is of the greater height is formed over substantially half the length of the separating element.

The invention is to be described in more detail with reference to the following description of the figures, in which:

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
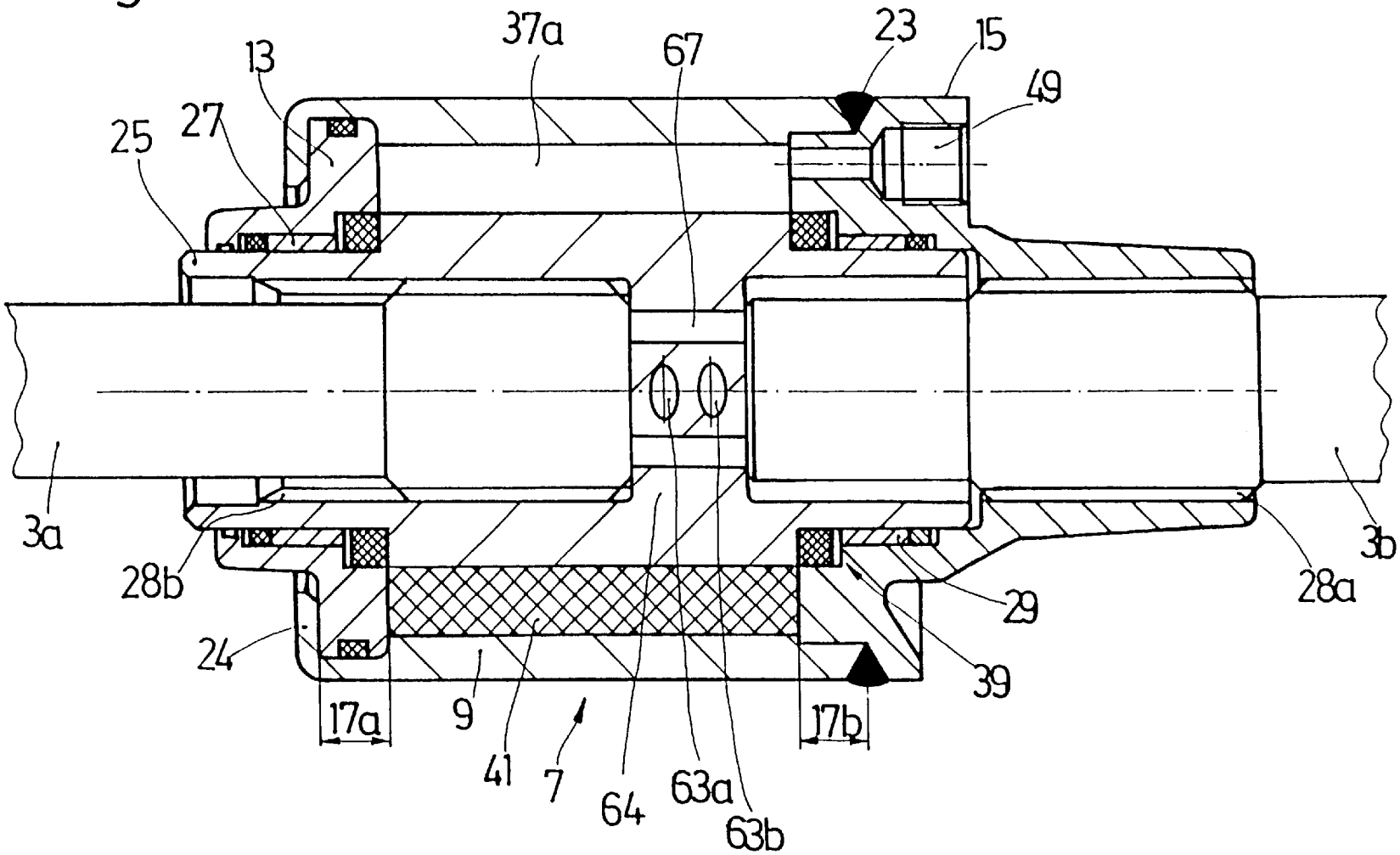
FIG. 1 shows the installed position of a sealing strip with reference to an oscillating motor.
Figure 2:
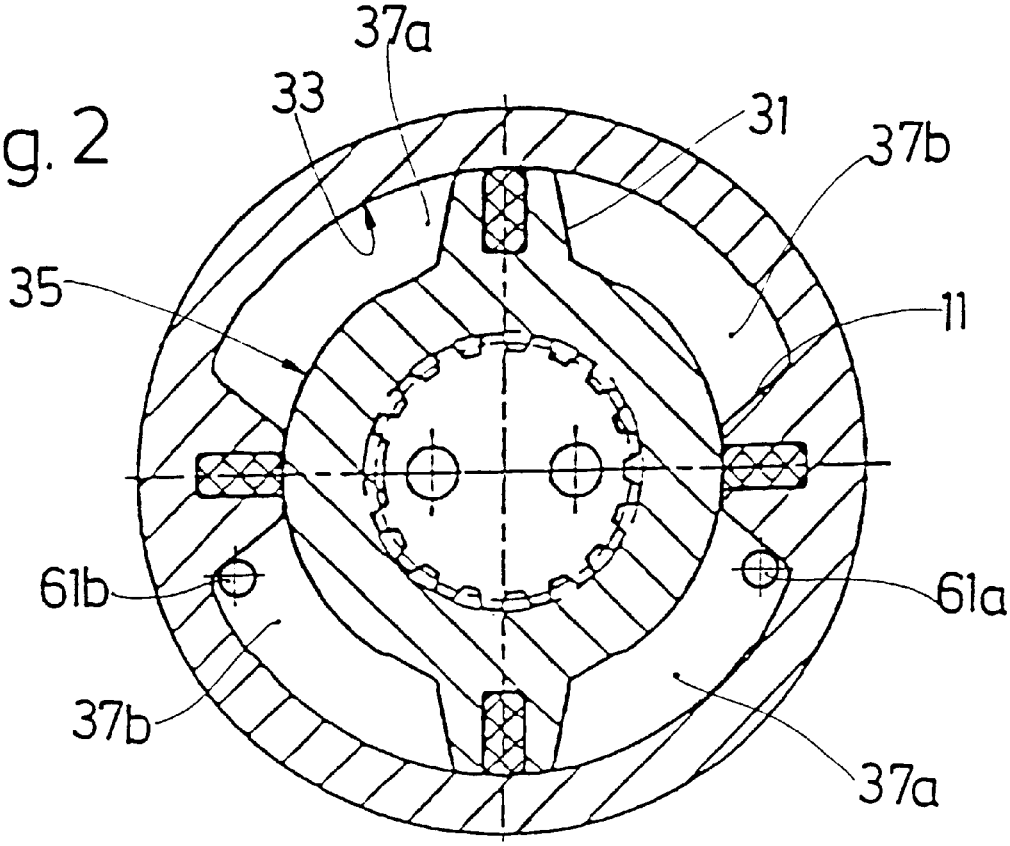
FIG. 2 shows a cross section through an oscillating motor.

FIG. 1 shows part of a stabilizer 3 with the stabilizer parts 3*a; b* and an oscillating motor 7, as used, for example, in an adjustable stabilizer for influencing rocking behavior. FIG. 2 is also included in the following description. The oscillating motor 7 includes, a cylinder 9, on the internal diameter of which axially running ribs 11 are arranged. The ribs 11 and the cylinder 9 are of integral design. At both end sides of the cylinder 9, a cap 13 and a cap 15 delimit a working space. The caps 13 and 15 have an overlap 17*a /b* with the cylinder 9. The position of the caps 13 and 15 inside the cylinder 9 is determined by the end faces of the ribs 11. The cap 15 is connected to the cylinder 9 via a weld seam 23. In this case, the overlap 17*b* is kept as short as possible, in order to minimize a theoretical lever arm for a radially acting compressive force in the working space, which in conjunction with the compressive force acting on the weld seam 23 exerts a bending moment. Via a rolled collar 24, the cap 13 is fixed inside the oscillating motor. As an alternative to the rolled collar, the connection may also be formed by at least a partial beading. The result is the formation of closed surfaces which are connected to the residual collar by transitions. The production of such a deformation is made very simple in that a ram is pressed from the outside inward in the radial direction into the collar, the width of the ram tool defining the width of the closed surfaces.

Inside the working space, a motor shaft 25 is equipped with a connection 28*b* in the form of an internal profile, so that a component which is to be rotated can be connected to the oscillating motor. The motor shaft 25, which is rotatably mounted by means of sliding-contact bearings 27, 29, has a number of vanes 31, which have the same axial orientation as the ribs 11 of the cylinder 9, on its external diameter.

The ribs 11 and the inner wall surface 33 of the cylinder 9, as well as the vanes 31 and the outer circumferential surface 35 of the motor shaft 25, form working chambers 37*a*, 37*b*. The working chambers 37*a*, 37*b* are sealed by means of axial seals 39 in the root region of the vanes 31 between the caps 13, 15 and the vanes 31, and by sealing strips 41, which are only outlined, in the ribs and vanes in this application example.

The cap 15 is provided with a first hydraulic port 49 and a second hydraulic port 51, which are arranged parallel to the main axis of the oscillating motor 7; for reasons of clarity, only the main port 49 is shown. The hydraulic ports 49/51 are deliberately fitted into the welded-in cap 15, since at this cap the hydraulic ports are always stationary relative to a connection 28*a* for an adjoining component, for example the stabilizer part 3*b*. Each of the two hydraulic ports 49, 51 is directly connected in each case to one other working chamber 37*a*, 37*b*. In addition, via a connection system there is a connection between the working chambers 37*a*, 37*b* with the same suffix, the interconnected working chambers 37*a* of the first hydraulic port 49 alternating with the working chambers 37*b* of the second hydraulic port 51. The connection system comprises two connecting openings 63*a; b* which are formed inside the base 64 of the motor shaft 25. The transversely running connecting openings 63*a; b* end in a diameter region 25*a* which has a smaller diameter than the further diameter region with respect to the transverse plane. On the one hand, the sealing strips 41 can be pushed into the ribs 11 more easily, and on the other hand a disk seal is effectively prevented from causing wear to an end of the connecting openings 63*a; b*. The base is part of a blind bore in the motor shaft. In this exemplary embodiment, the base is integrally connected to the motor shaft. However, press fit connections or welded joints are also conceivable.

The method of operation is extremely simple. Hydraulic medium at excess pressure flows into the oscillating motor 7 via one of the two hydraulic ports 49, 51, for example port 49. The medium passes via one of the axial ducts 61*a* or 61*b* and, from there, onward via the connecting openings 63*a; b*, into the respectively connected working chamber. The pressure inside the connected working chambers 37*a* which have been supplied with high-pressure hydraulic medium brings about a relative rotary movement between the motor shaft 25 and the cylinder 9. The hydraulic medium from the working chambers 37*b* which have not been supplied is displaced by the relative movement between the ribs 11 and vanes 31, via the axial duct, into a reservoir (not shown).

This description is merely intended to explain the situation in which the sealing strip 41 is fitted. The oscillating motor may also be designed differently, in particular with regard to the form of the connection system between working chambers and the hydraulic ports.

Figure 3:
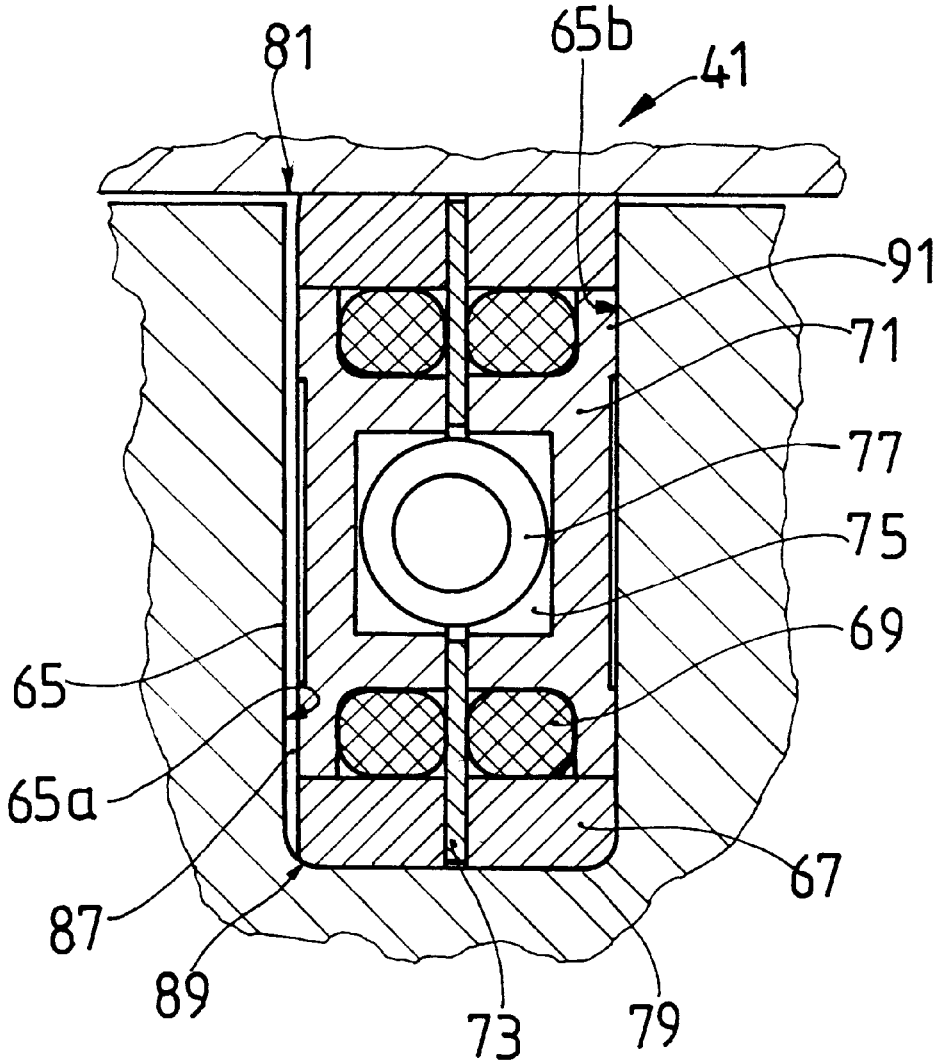
FIG. 3 shows a detailed illustration of the sealing strip in cross section.

FIG. 3 shows a detailed cross section through the sealing strip 41 inside a groove 65 which is delimited by the caps 13; 15. It includes, a frame-like sealing body 67, which is held by a preloading element 69, which is likewise frame-like, on a filler piece 71. This structure is designed mirror-symmetrically with respect to a separating element 73, the filler pieces each having at least one pocket-like cutout 75, in which a spring element 77, which clamps the two mirror-symmetrical individual sealing strips together in the longitudinal direction, is arranged. The preloading element 69 acts vertically and in the longitudinal direction, so that the sealing element 67 is clamped between a groove base 79 and the wall 81. The separating element 73 does not have to cover the entire filler piece 71, but rather only the outer edge to the sealing bodies 67.

Figure 4:
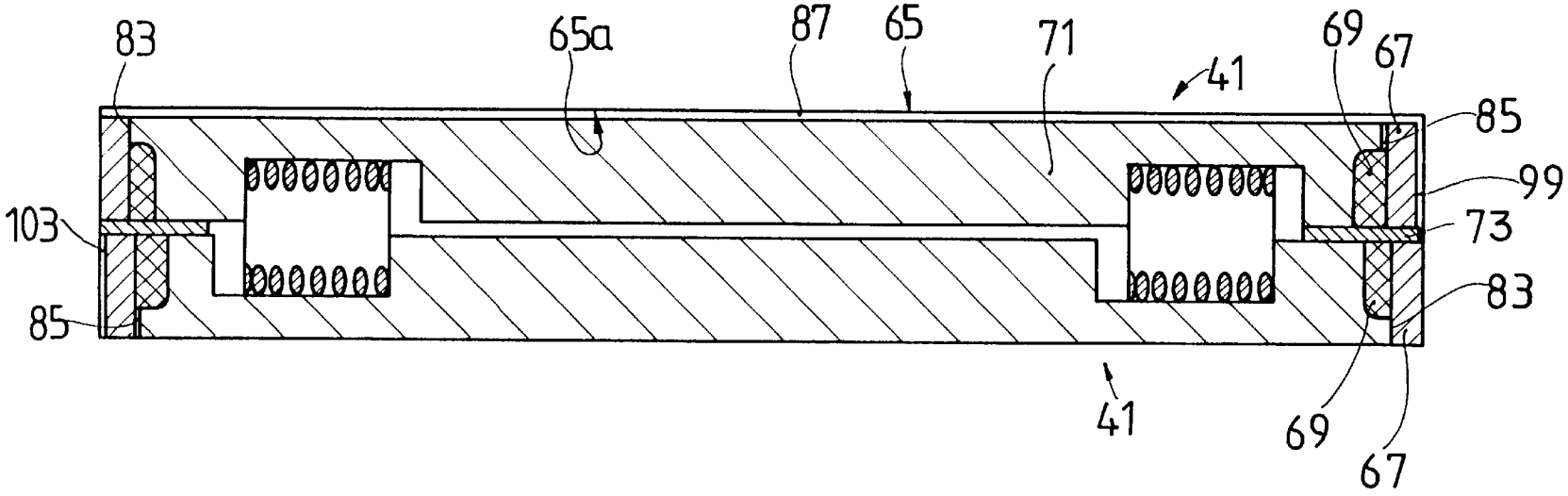
FIG. 4 shows a detailed illustration of the sealing strip in vertical section.

FIG. 4 shows the arrangement in a vertical section. In each case one sealing strip 41 is slightly shorter than the groove 65 in which the sealing strip as a whole is arranged. As a result, each individual sealing strip 41 has one end face 83 which is under spring load and one end face 85 which is not under spring load. As can be seen from FIG. 4, the groove 65 is slightly wider than the sealing strip as a whole, so that the halves of the sealing strip can move in the longitudinal direction with respect to one another. The separating element 73 ensures that the adjacent filler pieces 71, the preloading elements 69 and the sealing bodies 67 do not come into contact. In particular in the event of an operating pressure in a longitudinal gap 87 between a groove side wall 65*a* and the sealing strip, a transverse force is generated which, without a separating element, could displace a sealing body or even a preloading element of one sealing strip onto the filler piece of the other sealing strip, which would at least impede relative movement between the halves of the sealing strip as a whole.

To ensure that it is not possible for a gap to form on the sealing strip half 41 which is pressed against the groove side wall 65*b*, the sealing bodies have transition surfaces 89 in the form of rounded sections with a radius which is larger than an almost inevitable transition between the groove base 79 and the groove side wall 65*a*; 65*b*. The transition surfaces 89 are formed on both sides of the sealing body 67, so that during assembly it is impossible to fit the sides the wrong way round.

To improve installation of the preloading element 69, the filler piece 71 has an encircling web 91 on which the preloading element 69 can be supported in the transverse direction. Furthermore, the web 91 has the purpose of using its end face to absorb the forces which arise as a result of the preloading of the spring elements in the longitudinal direction of the sealing strip and, in the process, reducing the force which is introduced into the preloading body. This arrangement is likewise illustrated in FIG. 4. Moreover, the preloading element is protected from being overloaded for example in the event of temperature-related contraction of the sealing body.

Figure 5:
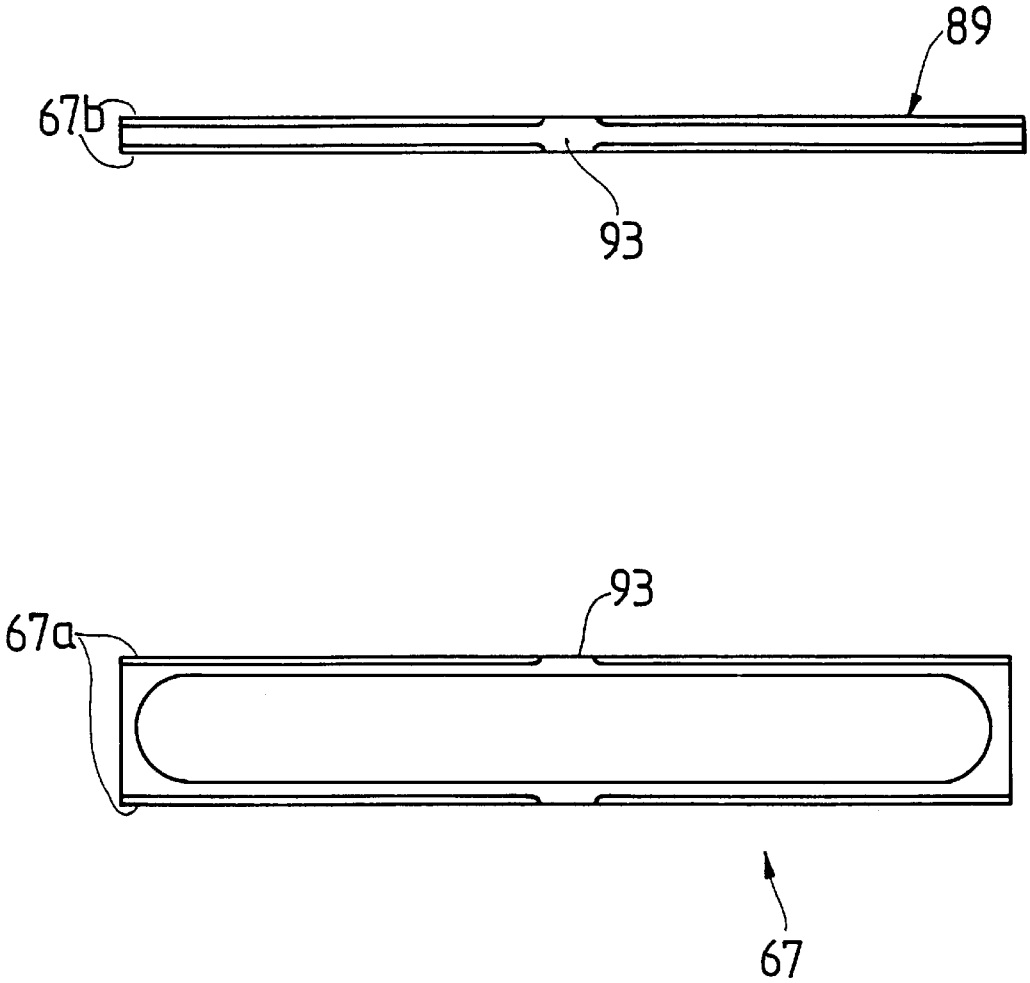
FIG. 5 shows a sealing body as an individual part.

FIG. 5 shows the sealing body 67 as an individual component. The transition surfaces 89 are formed on both sides between the sealing surface 67*a* on the groove base side and the sealing surface 67*b* on the groove wall side. Centrally with respect to the longitudinal extent of the body, there is a deformation area 93 which does not have a transition surface and is designed with corners which are as sharp-edged as possible.

Figure 6:
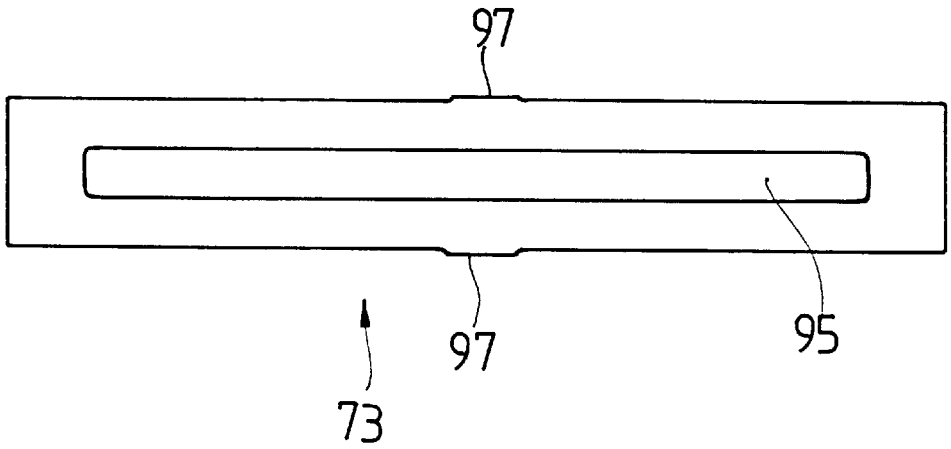
FIG. 6 shows a separating element as an individual part.

The separating element 73 shown in FIG. 6 is of very similar design. The separating element has a transverse opening 95 that can accommodate the spring elements 77. Furthermore, on the separating element there is a region of the length 97 which is also of relatively great height in the center with respect to the longitudinal axis of the separating element. The height of the separating element is slightly oversized with respect to the distance between the groove wall 79 and wall 81 (FIG. 3). The frame-like design was selected to allow the maximum possible elasticity with respect to the height axis. The separating element preferably consists of a metallic material, in order to withstand the operating pressure in the transverse direction. The length region of greater height, limited to itself, can only be deformed to an insignificant extent if the clamping in the vertical direction is limited with a view to the lowest possible friction. Due to the transverse opening 95, the separating element can be deformed elastically like a spring in the height axis without the separating element having to be deformed in the shape of a curve in the vertical direction. Therefore, the planar separating element can be responsible for a sealing function with respect to the individual sealing strip.

Figure 7:
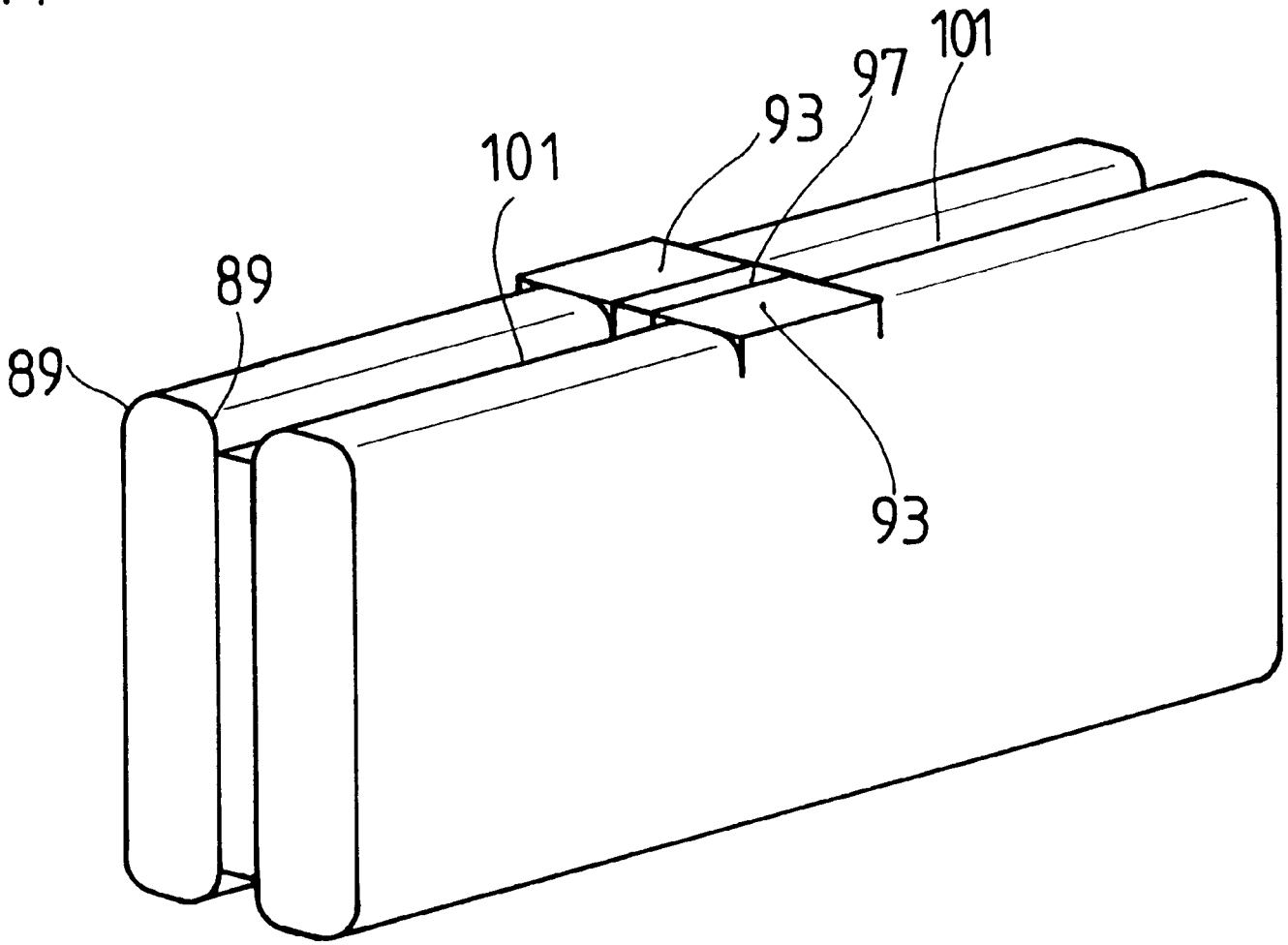
FIG. 7 shows a three-dimensional illustration of the sealing strip inside a groove.
Figure 8A:
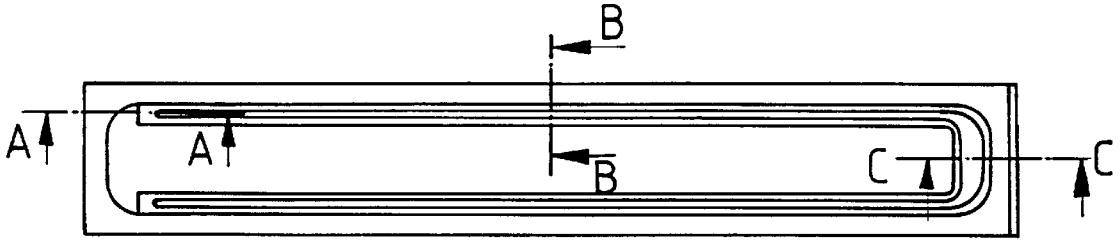
FIGS. 8*a*–8*d* show a modification of the sealing strip from FIG. 3.
Figure 8B:
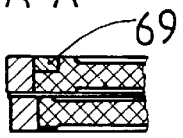
Figure 8C:
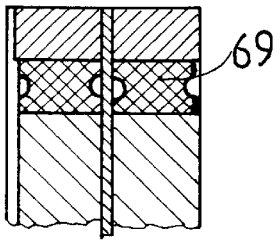
Figure 8D:
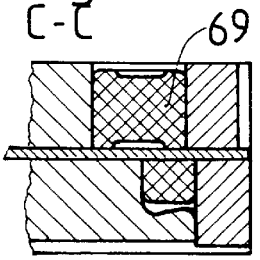

The reasons for the structural outlay on the deformation areas 93 and the elastic deformability of the separating element become clearer when FIG. 4 and FIG. 7 are considered together.

As can be seen from FIG. 4, there is a pressurized gap 87 parallel to the sealing strip. This gap has a connection to an end-side gap 99 between that end face of the sealing body which is not under spring load and the groove end. It can be seen from FIG. 7 that, due to the transition surfaces 89 on the sealing bodies 67, a channel 101 is formed, which runs in the longitudinal direction of the sealing strip, and through which the operating medium in the oscillating motor could reach the other end-side gap 103 and thus bridge the entire sealing strip. This channel is sealed by the deformation area 93 of the sealing bodies and the length region 97, of the separating element, of greater height; due to the fact that the deformation area and said length region are each arranged in the center, there is an overlap so that the medium is in any event prevented from flowing around the deformation areas.

Figure 9B:
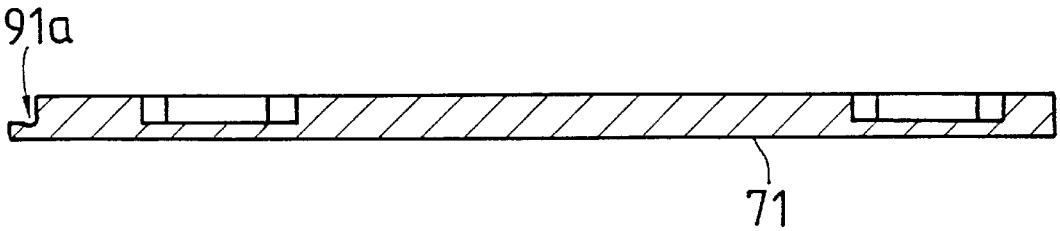
FIGS. 9*a*–9*b* show the filler piece from FIG. 3.
Figure 9A:
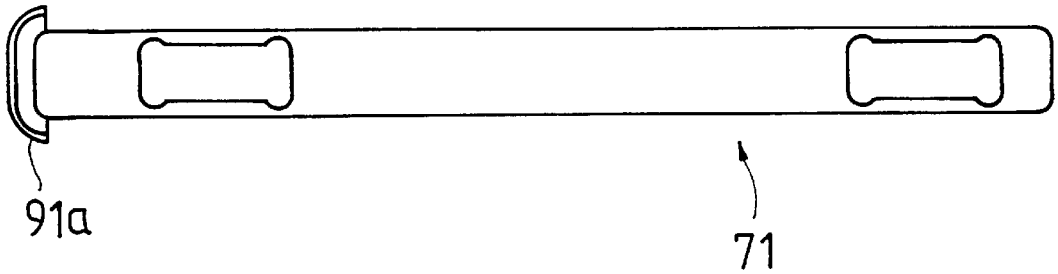

The design of the sealing strip in FIGS. 9*a–b* is intended to make it clear that it is appropriate to adapt the cross section of the preloading element 69 to the particular requirements at various sections. To do this, unlike in FIG. 3, the web is limited to one end-side web section 91*a*, as can be seen from FIG. 9*a*. With this measure, it is possible to achieve a greater design freedom for dimensioning the preloading element. Furthermore, the preloading element is more directly exposed to the operating pressure of the operating medium in the oscillating motor, without the restricting influence of the encircling web, with the result that the dynamic pressures of the operating medium can be transmitted more directly to the preloading element and the preloading forces are adapted more specifically to the operating state. Furthermore, the sealing body is more uniformly preloaded by the preloading element, in particular with respect to the side edge, in the transverse direction.

It can be seen from the sectional illustrations shown in FIGS. 8*a*–8*d* that the preloading element has its smallest cross section at the end face which is subject to spring load, a medium cross section between the end faces and its largest cross section at the end face which is not subject to spring load.

The invention is not limited by the embodiments described above which are presented as examples only but can be modified in various ways within the scope of protection defined by the appended patent claims.

We claim:

1. A sealing strip for sealing a space between two parts of a machine, the two parts forming a groove for receiving the sealing strip, the groove having at least one wall along a longitudinal direction, a top and a base, the sealing strip comprising:

a filler piece having a top end and a bottom end and being divided into two filler piece parts along the longitudinal direction, the filler piece parts being capable of independent longitudinal displacement with respect to one another;

at least one spring element between the filler piece parts for preloading the filler piece in the groove;

a sealing body for the top end and a sealing body for the bottom end of the filler piece, each sealing body being formed in a frame-like shape for surrounding its respective end of the filler piece; and a separating element arranged between the filler piece parts for separating the filler piece parts, wherein the separating element extends longitudinally from an end of the divided filler piece to at least a point where the sealing body surrounds the divided filler piece.

2. The sealing strip according to claim 1, wherein the divided filler piece has at least one cutout on an interior side of the divided filler piece opposite the groove wall for accommodating the at least one spring element.

3. The sealing strip according to claim 1, further comprising:

at least one preloading element arranged at an end of the filler piece for preloading the sealing strip into the groove, the preloading element having two ends; and a web part of the filler piece surrounding the filler piece and the at least one preloading element for defining the position of the preloading element inside the sealing strip and guiding the sealing strip into the groove.

4. The sealing strip according to claim 3, wherein the web is at least one web section formed on only a side of one end of the filler piece.

5. The sealing strip according to claim 4, wherein the web section is formed on only one of the filler piece parts.

6. The sealing strip according to claim 3, wherein the at least one preloading element has different cross-sectional sizes along its length.

7. The sealing strip according to claim 6, wherein each filler piece part is under spring load on only one end, the preloading element having an intermediate cross-section in a region where the preloading element contacts a top and a bottom side of the filler piece part, the intermediate cross-section being an average of the different cross-sectional sizes.

8. The sealing strip according to claim 6, wherein each filler piece part is under spring load on only one end, the preloading element having a cross section in a region of an end of the filler piece not subject to the spring load that is a larger of the different cross-sectional sizes.

9. The sealing strip according to claim 6, wherein each filler piece part is under spring load on only one end, the preloading element having a cross section in a region of an end of the filler piece subject to the spring load that is a smaller of the different cross-sectional sizes.

10. The sealing strip according to claim 9, wherein the separating element has at least one transverse opening for increasing the elasticity of the separating element.

11. The sealing strip according to claim 1, wherein the at least one sealing body further comprises a transition surface in at least one of a region between a sealing surface on the groove base and a sealing surface on the groove wall side and a region between a sealing surface on the groove base and a sealing surface on the groove top.

12. The sealing strip according to claim 11, wherein the sealing surface on the groove base side and the sealing surface on the groove wall side have a defined deformation area.

13. The sealing strip according to claim 12, wherein the separating element has a length region along the longitudinal direction that is greater than a height of the groove.

14. The sealing strip according to claim 13, wherein the divided filler piece has at least one cutout on an interior side of the divided filler piece opposite the groove wall; and the length region is arranged in the region of the cutout.

15. The sealing strip according to claim 13, wherein the defined deformation area of the sealing body and the length region overlap in the longitudinal direction of the sealing strip.

16. The sealing strip according to claim 13, wherein the length region is formed over substantially half the length of the separating element.

17. The sealing strip according to claim 1, wherein the separating element is elastic along a plane perpendicular to a direction of force from the at least one spring element.

* * * * *